US011735822B2

(12) United States Patent
Flores-Cuadras

(10) Patent No.: US 11,735,822 B2
(45) Date of Patent: Aug. 22, 2023

(54) ANTENNA SYSTEM WITH SHORT CABLE

(71) Applicant: 2J ANTENNAS USA, CORPORATION, Gilbert, AZ (US)

(72) Inventor: Javier Ruben Flores-Cuadras, Chandler, AZ (US)

(73) Assignee: 2J ANTENNAS USA, CORPORATION, Gilbert, AZ (US)

( * ) Notice: Subject to any disclaimer, the term of this patent is extended or adjusted under 35 U.S.C. 154(b) by 0 days.

(21) Appl. No.: 17/738,320

(22) Filed: May 6, 2022

(65) Prior Publication Data

US 2022/0359986 A1 Nov. 10, 2022

Related U.S. Application Data

(60) Provisional application No. 63/185,177, filed on May 6, 2021.

(51) Int. Cl.
*H01Q 9/04* (2006.01)
*H01Q 5/15* (2015.01)

(52) U.S. Cl.
CPC ..... *H01Q 9/0414* (2013.01); *H01Q 5/15* (2015.01)

(58) Field of Classification Search
CPC ..... H01Q 9/0414; H01Q 9/42; H01Q 5/15; H01Q 5/371; H01Q 21/205; H01Q 21/28
See application file for complete search history.

(56) References Cited

U.S. PATENT DOCUMENTS 11,316,276 B2 4/2022 Flores-Cuadras
2010/0066612 A1* 3/2010 Tai ..... H01Q 9/40 343/846
2018/0316081 A1* 11/2018 Nguyen ..... H01Q 9/40

FOREIGN PATENT DOCUMENTS

CN 208548451 U * 2/2019 ..... H01Q 1/36

* cited by examiner

*Primary Examiner* — Hoang V Nguyen
(74) *Attorney, Agent, or Firm* — CP Law Group PC; Cy Bates

(57) ABSTRACT

The disclosure concerns an antenna system having a clearance zone coupled to an antenna element, the clearance zone being further coupled to a ground plane. The antenna element and ground plane are electrically coupled by a short cable having a short cable routing. The short cable routing includes at least one bend wherein a portion of the short cable is disposed above the clearance zone. The short cable creates a bridging effect which reduces form factor while retaining lower frequency resonance.

20 Claims, 8 Drawing Sheets

ANTENNA SYSTEM WITH SHORT CABLE

CROSS-REFERENCE TO RELATED APPLICATIONS

This application claims benefit of priority with U.S. Provisional Application Ser. No. 63/185,177, filed May 6, 2021; the entire contents of which are hereby incorporated by reference.

BACKGROUND

Field of the Invention

This invention relates to antennas; more particularly, antenna systems having a short cable with specific short cable routing to induce a bridging effect.

Description of the Related Art

Generally, antennas which are much larger have a long cable, where the cable is not considered part of the antenna and routing is not important. Having a larger cable length can assist with better antenna performance but comes with the downside of having an overall larger antenna footprint. Current antennas covering the spectrum of 600 MHz-6 GHz generally have a footprint of 138 mm×25 mm, or larger There is a need for antennas having a smaller antenna footprint without sacrificing antenna performance or preferred bandwidth.

SUMMARY

The disclosure concerns an antenna system having a clearance zone coupled to an antenna element, the clearance zone being further coupled to a ground plane. The antenna element and ground plane are electrically coupled by a short cable having a short cable routing. The short cable routing comprises at least one bend wherein a portion of the short cable is disposed above the clearance zone. The short cable creates a bridging effect which reduces form factor while retaining lower frequency resonance.

With the antenna system having the short cable and specific short cable routing, sizes of 20×40 mm were achieved while efficiently operating in a bandwidth of 600 MHz to 6 GHz. Return Loss parameter for the working frequency from 600 MHz to 6000 MHz averaged −5 dB or better across the band of interest. Efficiency averaged 50% across the band of interest, with a peak efficiency of 70% while having a 40% efficiency across the band of interest. The short cable creates a bridge effect between the ground plane and the antenna element. Different short cable routings can allow for accommodations to module sensitivity where the module may prefer one routing over another.

The antenna system disclosed herein may be adapted to cover other frequencies for different communication standard like ISM, Wi-Fi, Bluetooth, GNSS, or the like.

BRIEF DESCRIPTION OF THE DRAWINGS

Other features, combinations, and embodiments will be appreciated by one having the ordinary level of skill in the art of antennas a upon a thorough review of the following details and descriptions, particularly when reviewed in conjunction with the drawings, wherein.

DETAILED DESCRIPTION

Figure 1:
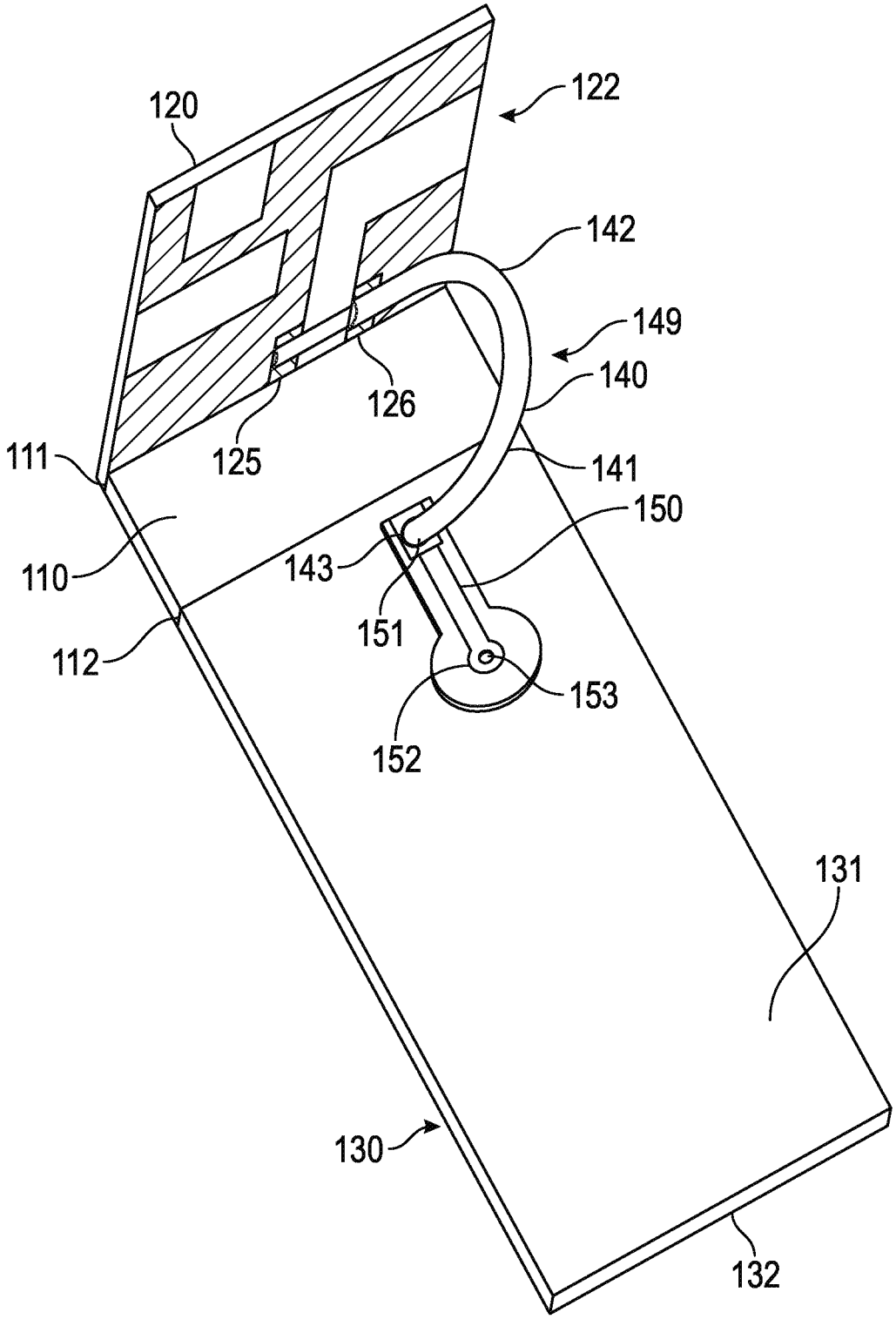
FIG. 1 shows a perspective view of an antenna system in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

Unless explicitly defined herein, terms are to be construed in accordance with the plain and ordinary meaning as would be appreciated by one having skill in the art.

GENERAL DESCRIPTION OF EMBODIMENTS

In one embodiment, an antenna system is disclosed. The antenna system comprises a clearance zone having a first end and a second end opposite the first end, an antenna element coupled to the clearance zone at the first end, the antenna element and clearance zone forming an antenna angle, a ground plane coupled to the clearance zone at the second end, the ground plane having a top surface and a bottom surface opposite the top surface, and a short cable coupled to the top surface at a ground terminal and further coupled the antenna element, the short cable having a short cable routing wherein the short cable routing comprises at least one bend.

In some embodiments, the antenna element may further comprise a plurality of elements, wherein at least one of the plurality of elements comprises a collinear element and at least one of the plurality of elements comprises a non-collinear element.

In some embodiments, the antenna element may further comprise a plurality of elements, wherein each of the plurality of elements comprises either a collinear element or a non-collinear element.

In some embodiments, the ground plane may further comprise a transmission line disposed on the top surface, the transmission line having a first terminal and a second terminal, wherein the first terminal is electrically coupled to the ground terminal, and the transmission line extends from the first terminal away from the antenna element.

In some embodiments, the antenna system may further comprise a connector electrically coupled to the second terminal.

In some embodiments, the connector may be disposed on the bottom surface of the ground plane.

In some embodiments, the short cable routing may comprise one of a forward S, a forward L, a forward C, an inverted S, an inverted L, or an inverted C.

In some embodiments, the antenna angle may comprise an angle between an inclusive of ninety and two-hundred and seventy degrees.

In another embodiment, a MIMO system is disclosed. The MIMO system comprises a system substrate comprising a center portion, a perimeter bordering the center portion, and a substrate periphery having a plurality of sides, a clearance zone disposed on the perimeter, a ground plane disposed on the center portion, and a plurality of antenna systems disposed on the substrate periphery. Each of the plurality of antenna systems comprises an antenna element coupled to the clearance zone, the antenna element and clearance zone forming an antenna angle, a short cable coupled to the ground plane at a ground terminal and further coupled the antenna element, the short cable having a short cable routing wherein the short cable routing comprises at least one bend.

In some embodiments, each of the antenna elements may further comprise a plurality of elements, wherein at least one of the plurality of elements comprises a collinear element and at least one of the plurality of elements comprises a non-collinear element.

In some embodiments, each of the antenna elements may further comprise a plurality of elements, wherein each of the plurality of elements comprises either a collinear element or a non-collinear element.

In some embodiments, each of the short cable routings may comprise one of a forward S, a forward L, a forward C, an inverted S, an inverted L, or an inverted C.

In some embodiments, each of the plurality of sides may comprise two antenna systems, and the short cable routing of one of the antenna systems may comprise the forward S, forward L, or forward C. The short cable routing of one of the other antenna systems may comprise the inverted S, inverted L, or inverted C. In other embodiments the MIMO system may comprise an alternative number of antenna systems on each of the plurality of sides including one or four.

In some embodiments, the antenna angle may comprise an angle between an inclusive of ninety and one hundred and eighty degrees.

In another embodiment, a development kit is disclosed. The development kit comprises an antenna system and a plastic housing encapsulating at least a portion of the antenna system. The antenna system comprises a clearance zone having a first end and a second end opposite the first end, an antenna element coupled to the clearance zone at the first end, the antenna element and clearance zone forming an antenna angle, a ground plane coupled to the clearance zone at the second end, the ground plane having a top surface and a bottom surface opposite the top surface, and a short cable coupled to the top surface at a ground terminal and further coupled the antenna element, the short cable having a short cable routing, wherein the short cable routing comprises at least one bend. A connector electrically coupled to the short cable, the connector extending from the bottom surface of the ground plane.

In some embodiments, the antenna element may further comprise a plurality of elements, wherein at least one of the plurality of elements comprises a collinear element and at least one of the plurality of elements comprises a non-collinear element.

In some embodiments, the ground plane may further comprise a transmission line disposed on the top surface, the transmission line having a first terminal and a second terminal, wherein the first terminal is electrically coupled to the ground terminal, and the second terminal is electrically coupled to the connector.

In some embodiments, the short cable routing may comprise one of a forward S, a forward L, a forward C, an inverted S, an inverted L, or an inverted C.

In some embodiments, the antenna angle may comprise an angle between an inclusive of ninety and two-hundred and seventy degrees.

Manufacturing

Generally, substrates, ground planes, and clearance zones are made of industry standard material such as ceramic, plastic polymer, or low-cost fiberglass. Examples may include FR4, Kapton or Pyralux with printed circuit design affixed thereto. Otherwise, they can be fabricated in accordance with the level and knowledge of one having skill in the art. The ground plane and the clearance zone may comprise a same material. The ground plane may be visually thicker due to the presence of an internal conductive plane, such as cooper, disposed therein The collinear and noncollinear elements may be fabricated by etching an antenna element pattern in a metal trace bonded to an insulating dielectric substrate, such as a printed circuit board.

Specific short cable routings like ones disclosed herein can be achieved by use of SMT retainer, solder, glue, surface tape, or any other means appreciated by one having skill in the art.

Each of the components of the antenna and related system described herein may be manufactured and/or assembled in accordance with the conventional knowledge and level of a person having skill in the art. Shapes such as variations of the C, S, and L have an added advantage of reduced manufacturing labor and increased quality and durability While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

First Illustrated Embodiment

FIG. 1 shows a perspective view of an antenna system (100) in accordance with a first illustrated embodiment. The antenna system comprises a clearance zone (110) having a first end (111) and a second end (112). An antenna element (120) is coupled to the first end and comprises an antenna angle relative to the clearance zone. Coupled to the second end is a ground plane (130). The ground plane and clearance zone are generally coplanar such that they form a flat structure. Disposed on an antenna substrate (127) of the antenna element is a plurality of elements (122), a positive terminal pad (125) and a negative terminal pad (126). A short cable (140) is coupled to a top surface (131) of the ground plane and further coupled to the antenna element. The short cable comprises a short cable routing (141) having at least one bend (142). A shown, the short cable routing comprises an inverted C short cable routing (149). However, other short cable routings may also be utilized as disclosed further herein and as can be appreciated by one having skill in the art.

The clearance zone (110) is non-conductive to allow a bridging effect on the short cable (140) for better capturing of lower frequencies while maintaining a small form factor. If the clearance zone was conductive, it would act as a ground directly below the short cable and would negatively affect the bridging effect and the desired bandwidth. The second end (112) shows a junction of where conductive cooper plane (or other conductive material) within the ground plane (130) terminates. Generally, the first end (111) and second end are parallel to one another such that the clearance zone and ground plane form a flat, rectangular plane.

The short cable (140) couples to the antenna element (120) via a negative terminal pad (126) and a positive terminal pad (125). Generally, an outer conductor of the short cable couples first to the negative terminal pad, and an inner conductor subsequently couples to the positive terminal pad. The short cable couples to the ground plane (130) via a ground terminal (143). The short cable may be terminated to the ground terminal by a connector, such as a UFL, or can be stripped for direct soldering.

A transmission line (150) having a first terminal (151) and a second terminal (152) is disposed on the top surface (131) of the ground plane (130). The first terminal is coupled to the ground terminal (143), and the second terminal is coupled to a connector (153). The connector may be disposed on the top surface or a bottom surface (132) opposite the top surface. In other embodiments, the ground terminal may couple directly to the connector.

Figure 2A:
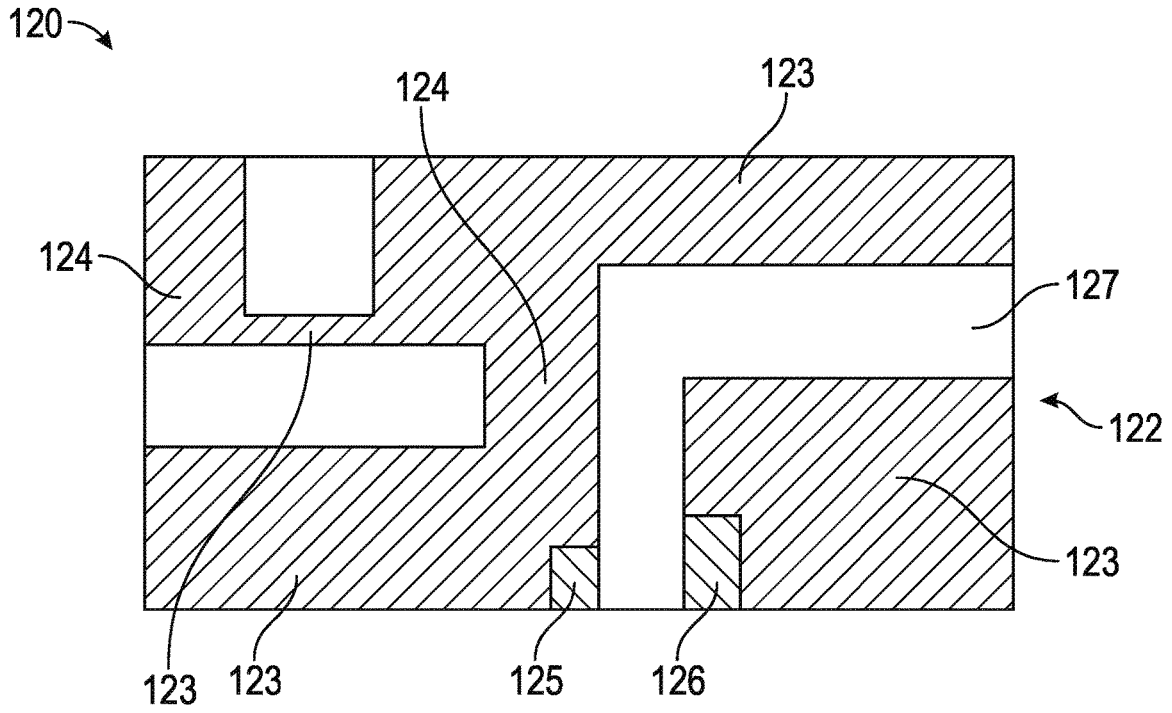
FIG. 2A. shows a front view of an antenna element of the antenna system according to the first illustrated embodiment.
Figure 2B:
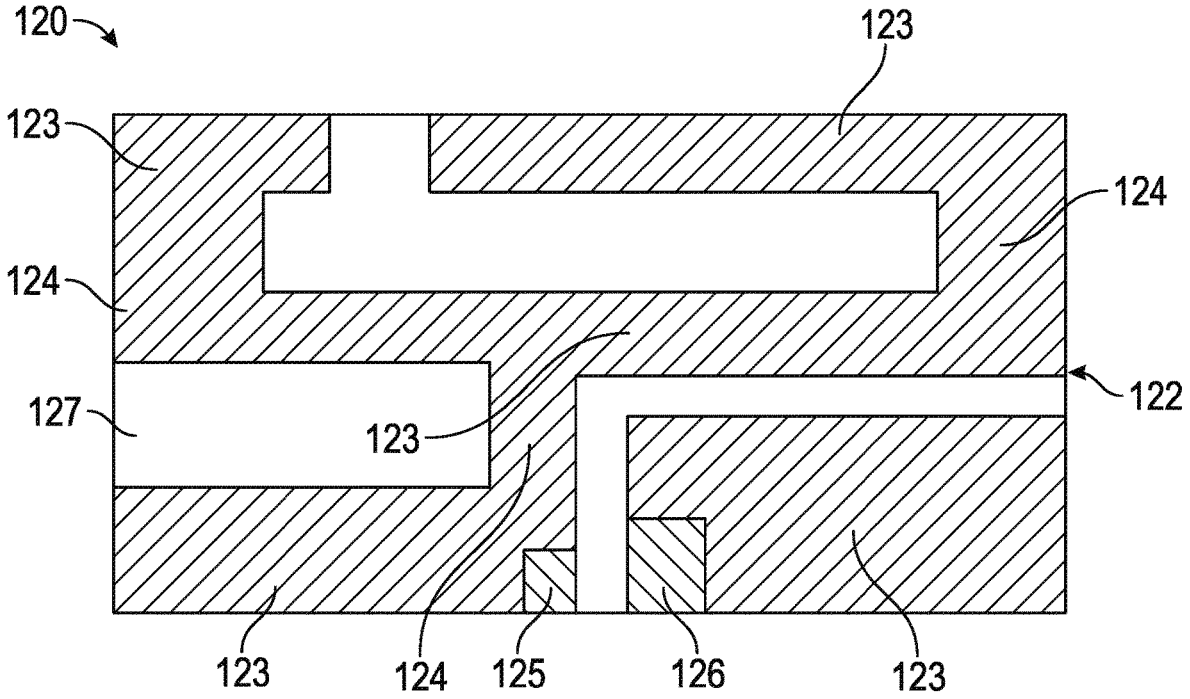
FIG. 2B shows a front view of an alternate antenna element of the antenna system according to the first illustrate embodiment.

FIG. 2A and FIG. 2B shows alternate front views of an antenna element (120) of the antenna system (100) according to the first illustrated embodiment. The antenna element comprises a plurality of elements (122) including at least one collinear element (123) and at least one non-collinear element (124). Each of the collinear elements comprises a predominate shape which is collinear with a junction formed between the clearance zone (110) and the ground plane (130), and is generally the second end (112) of the clearance zone. The collinear elements may be characterized as having a shape which horizontally wider than it is vertically tall relative to the ground plane.

Each of the noncollinear elements (124) comprises a predominate shape which is not collinear with the junction formed by the clearance zone (110) and ground plane (130), and is generally orthogonal to each of the collinear elements (123). The noncollinear elements may be characterized as having a shape which is vertically taller than it is horizontally wide being relative to the ground plane. The antenna element (120) further comprises a positive terminal pad (125) and a negative terminal pad (126) for coupling with a short cable (FIG. 1, 140). A nonconductive portion of the antenna substrate (127) is disposed between the positive and negative terminal pads to ensure electrical separation and prevent short circuits.

Figure 3C:
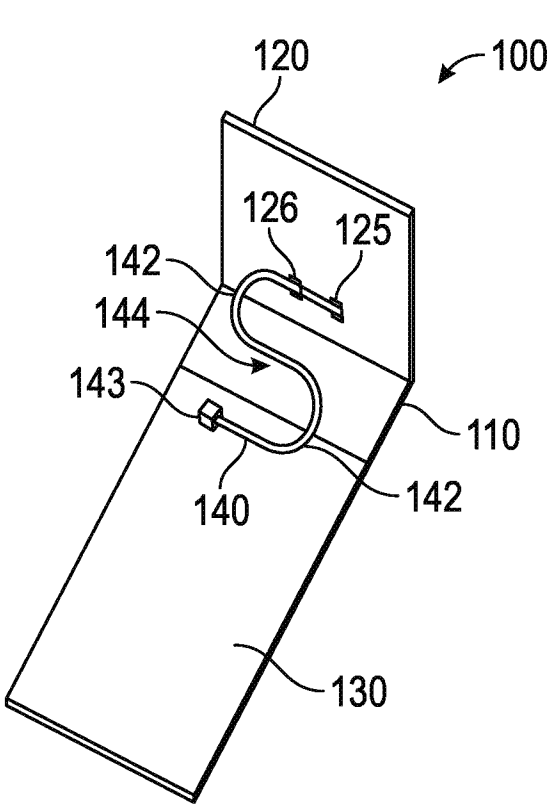
FIG. 3C shows the antenna system having a forward S short cable routing according to the first illustrated embodiment.
Figure 3B:
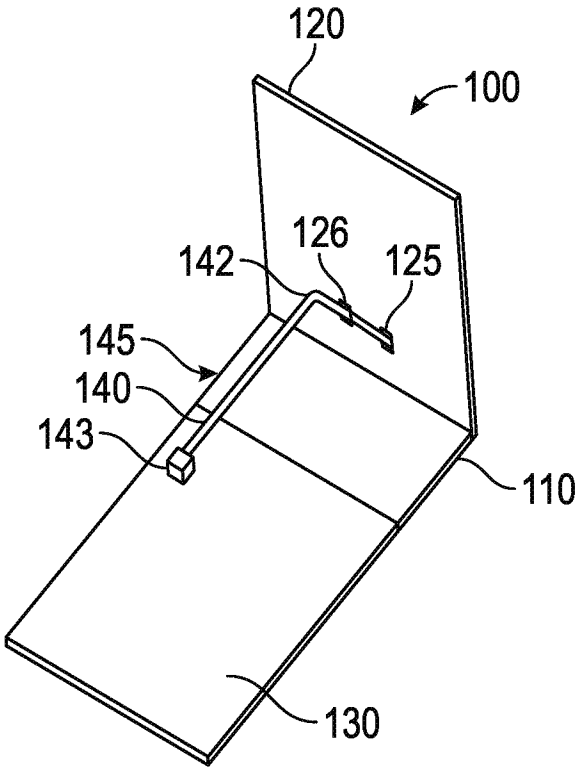
FIG. 3B shows the antenna system having a forward L short cable routing according to the first illustrated embodiment.
Figure 3A:
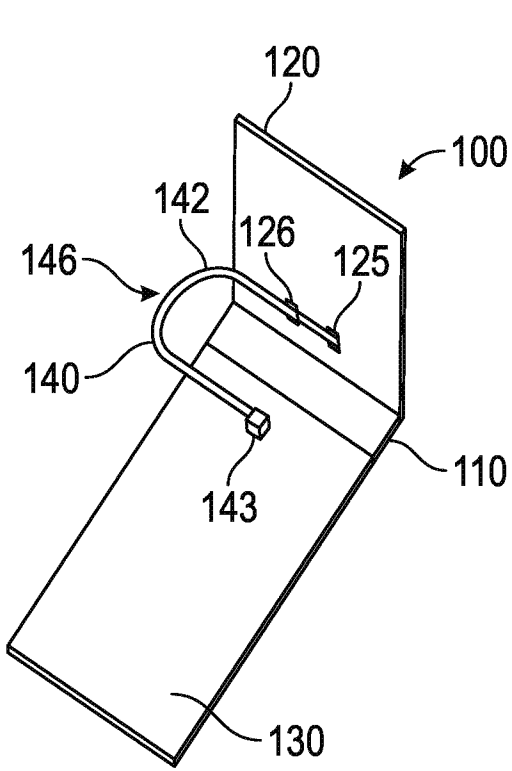
FIG. 3A shows the antenna system having a forward C short cable routing according to the first illustrated embodiment.

FIG. 3A shows the antenna system (100) having a forward C short cable routing (146) according to the first illustrated embodiment. The antenna system comprises a clearance zone (110) disposed between a ground plane (130) and an antenna element (120). The ground plane and the antenna element are electrically coupled by a short cable (140) having a short cable routing (141), namely the forward C short cable routing. The forward C short cable routing comprises at least one bend (142) and may comprise more depending on curvature of the forward C short cable routing. Having a specific short cable routing like ones disclosed in the present disclosure can reduce size of the antenna element and improve bandwidth. In some embodiments, at least a predominate portion of the bend of the short cable is disposed above the clearance zone.

The short cable (140) couples to the ground plane (130) via a ground terminal (143) and couples to the antenna element (120) via a negative terminal pad (126) and a positive terminal pad (125). As shown, the ground terminal is disposed horizontally between the positive and negative terminal pads. In other embodiments, the negative terminal pad is disposed horizontally between the ground terminal and the positive terminal pad. In yet other embodiments, the positive terminal pad is disposed horizontally between the ground terminal and the negative terminal pad.

FIG. 3B shows the antenna system (100) having a forward L short cable routing (145) according to the first illustrated embodiment. The antenna system comprises a clearance zone (110) coupled to a ground plane (130) and further coupled to an antenna element (120). The ground plane and the antenna element are electrically coupled by a short cable (140) having a short cable routing (141), namely the forward L short cable routing. The forward L short cable routing comprises a single bend (142) wherein the bend generally abuts the antenna element. Having a specific short cable routing like ones disclosed in the present disclosure can reduce size of the antenna element and improve bandwidth.

The short cable (140) couples to the ground plane (130) via a ground terminal (143) and couples to the antenna element (120) via a negative terminal pad (126) and a positive terminal pad (125). As shown, the ground terminal is disposed on the ground plane such that the negative terminal pad is horizontally disposed between the positive terminal pad and the ground plane.

FIG. 3C shows the antenna system (100) having a forward S short cable routing (144) according to the first illustrated embodiment. The antenna system comprises a plane having a clearance zone (110) and a ground plane (130). An antenna element (120) is coupled to the plane at the clearance zone. The ground plane and the antenna element are electrically coupled by a short cable (140) having a short cable routing (141), namely the forward S short cable routing. The forward S short cable routing comprises at least two bends (142) and may comprise more depending on curvature of the forward S short cable routing. Having a specific short cable routing like ones disclosed in the present disclosure can reduce size of the antenna element and improve bandwidth. In some embodiments, at least a predominate portion of each the bend of the short cable is disposed above the clearance zone The short cable (140) couples to the ground plane (130) via a ground terminal (143) and couples to the antenna element (120) via a negative terminal pad (126) and a positive terminal pad (125). As shown, the ground terminal is disposed on the ground plane such that the negative terminal paid is disposed horizontally between the positive terminal pad and the ground terminal. In other embodiments, the positive terminal pad is disposed horizontally between the ground terminal and the negative terminal pad. In yet other embodiments, the ground terminal is disposed horizontally between the positive terminal pad and the negative terminal pad.

Figure 4C:
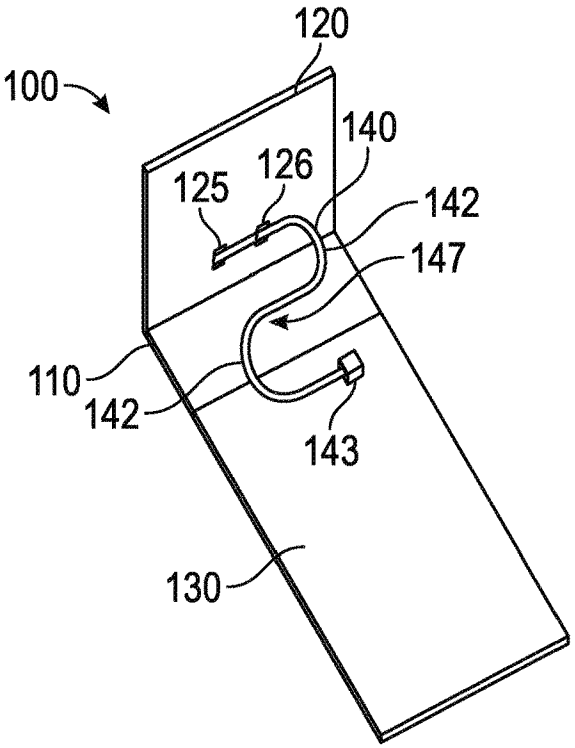
FIG. 4C shows the antenna system having an inverted S short cable routing according to the first illustrated embodiment.
Figure 4B:
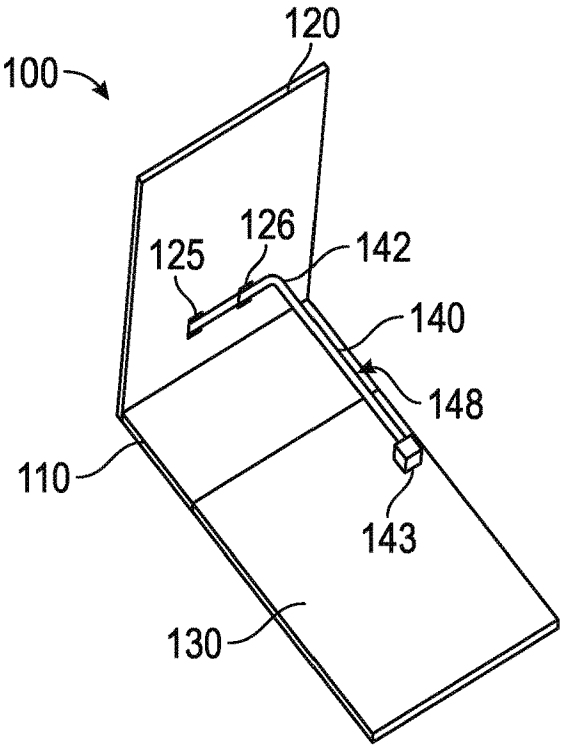
FIG. 4B shows the antenna system having an inverted L short cable routing according to the first illustrated embodiment.
Figure 4A:
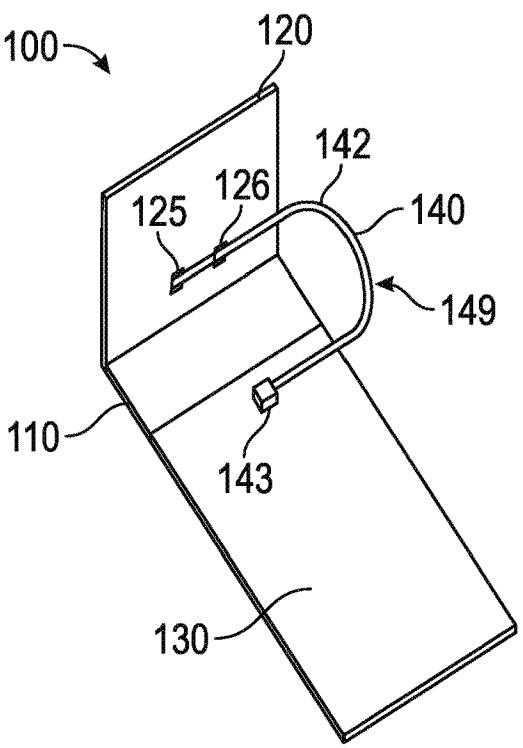
FIG. 4A shows the antenna system having an inverted C short cable routing according to the first illustrated embodiment.

FIG. 4A shows the antenna system (100) having an inverted C short cable routing (149) according to the first illustrated embodiment. The antenna system comprises a clearance zone (110) disposed between a ground plane (130) and an antenna element (120). The ground plane and the antenna element are electrically coupled by a short cable (140) having a short cable routing (141), namely the inverted C short cable routing. The inverted C short cable routing comprises at least one bend (142) and may comprise more depending on curvature of the inverted C short cable routing. Having a specific short cable routing like ones disclosed in the present disclosure can reduce size of the antenna element and improve bandwidth. In some embodiments, at least a predominate portion of the bend of the short cable is disposed above the clearance zone.

The short cable (140) couples to the ground plane (130) via a ground terminal (143) and couples to the antenna element via a negative terminal pad (126) and a positive terminal pad (125). As shown, the ground terminal is disposed horizontally between the positive and negative terminal pads. In other embodiments, the negative terminal pad is disposed horizontally between the ground terminal and the positive terminal pad. In yet other embodiments, the positive terminal pad is disposed horizontally between the ground terminal and the negative terminal pad.

FIG. 4B shows the antenna system (100) having an inverted L short cable routing (148) according to the first illustrated embodiment. The antenna system comprises a clearance zone (110) coupled to a ground plane (130) and further coupled to an antenna element (120). The ground plane and the antenna element are electrically coupled by a short cable (140) having a short cable routing (141), namely the inverted L short cable routing. The inverted L short cable routing comprises a single bend (142) wherein the bend generally abuts the antenna element. Having a specific short cable routing like ones disclosed in the present disclosure can reduce size of the antenna element and improve bandwidth.

The short cable (140) couples to the ground plane (130) via a ground terminal (143) and couples to the antenna element (120) via a negative terminal pad (126) and a positive terminal pad (125). As shown, the ground terminal is disposed on the ground plane such that the negative terminal pad is horizontally disposed between the positive terminal pad and the ground plane.

FIG. 4C shows the antenna system (100) having an inverted S short cable routing (147) according to the first illustrated embodiment. The antenna system comprises a plane having a clearance zone (110) and a ground plane (130). An antenna element (120) is coupled to the plane at the clearance zone. The ground plane and the antenna element are electrically coupled by a short cable (140) having a short cable routing (141), namely the inverted S short cable routing. The inverted S short cable routing comprises at least two bends (142) and may comprise more depending on curvature of the inverted S short cable routing. Having a specific short cable routing like ones disclosed in the present disclosure can reduce size of the antenna element and improve bandwidth. In some embodiments, at least a predominate portion of each the bend of the short cable is disposed above the clearance zone The short cable (140) couples to the ground plane (130) via a ground terminal (143) and couples to the antenna element (120) via a negative terminal pad (126) and a positive terminal pad (125). As shown, the ground terminal is disposed on the ground plane such that the negative terminal paid is disposed horizontally between the positive terminal pad and the ground terminal. In other embodiments, the positive terminal pad is disposed horizontally between the ground terminal and the negative terminal pad. In yet other embodiments, the ground terminal is disposed horizontally between the positive terminal pad and the negative terminal pad.

Figure 5:
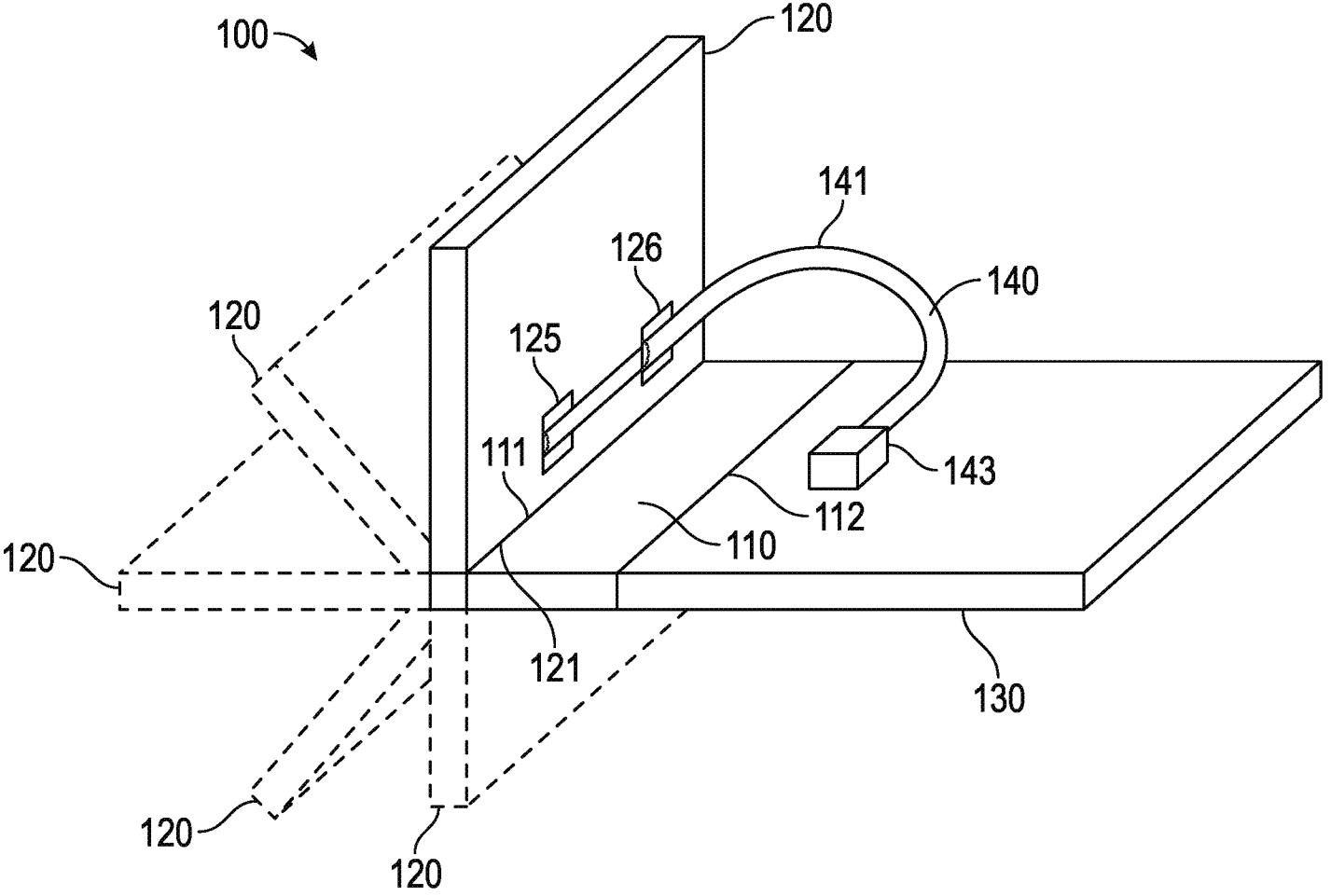
FIG. 5 shows a side view of the antenna system comprising various angles according to the first illustrated embodiment.

FIG. 5 shows a side view of the antenna system (100) comprising various antenna angles (121) according to the first illustrated embodiment. The antenna system comprises an antenna element (120) coupled to a clearance zone (110) and forming the antenna angle therewith. The clearance zone is further coupled to a ground plane (130) wherein the ground plane is coplanar with the clearance zone. The antenna element and the ground plane are electrically coupled by a short cable (140). The short cable is coupled to a negative terminal pad (126) and positive terminal pad (125) of the antenna element, and is further coupled to the ground plane by a ground terminal (143). Due to a coplanar relationship between the clearance zone and the ground plane, an angle between the ground plane and antenna element equal to the antenna angle between the antenna element and the clearance zone.

The antenna element (120) is fixedly coupled to the clearance zone (110) without rotation. FIG. 5 is illustrating different antenna angles (121) for which the antenna system (100) may comprise. The antenna angle may comprise 90 degrees, 180 degrees, 270 degrees, between 90 and 180 degrees, between 180 and 270 degrees, or other angles as can be appreciated by one having skill in the art. Dotted figures of the antenna element shown are intended to illustrate alternative configurations of the antenna system. Once orientation has been determined, the short cable (140) and corresponding short cable routing (141) can be installed coupled the antenna element with the ground plane (130). The short cable routing is shown as an inverted C short cable routing (149). Other short cable routings may also be utilized.

Second Illustrated Embodiment

Figure 6:
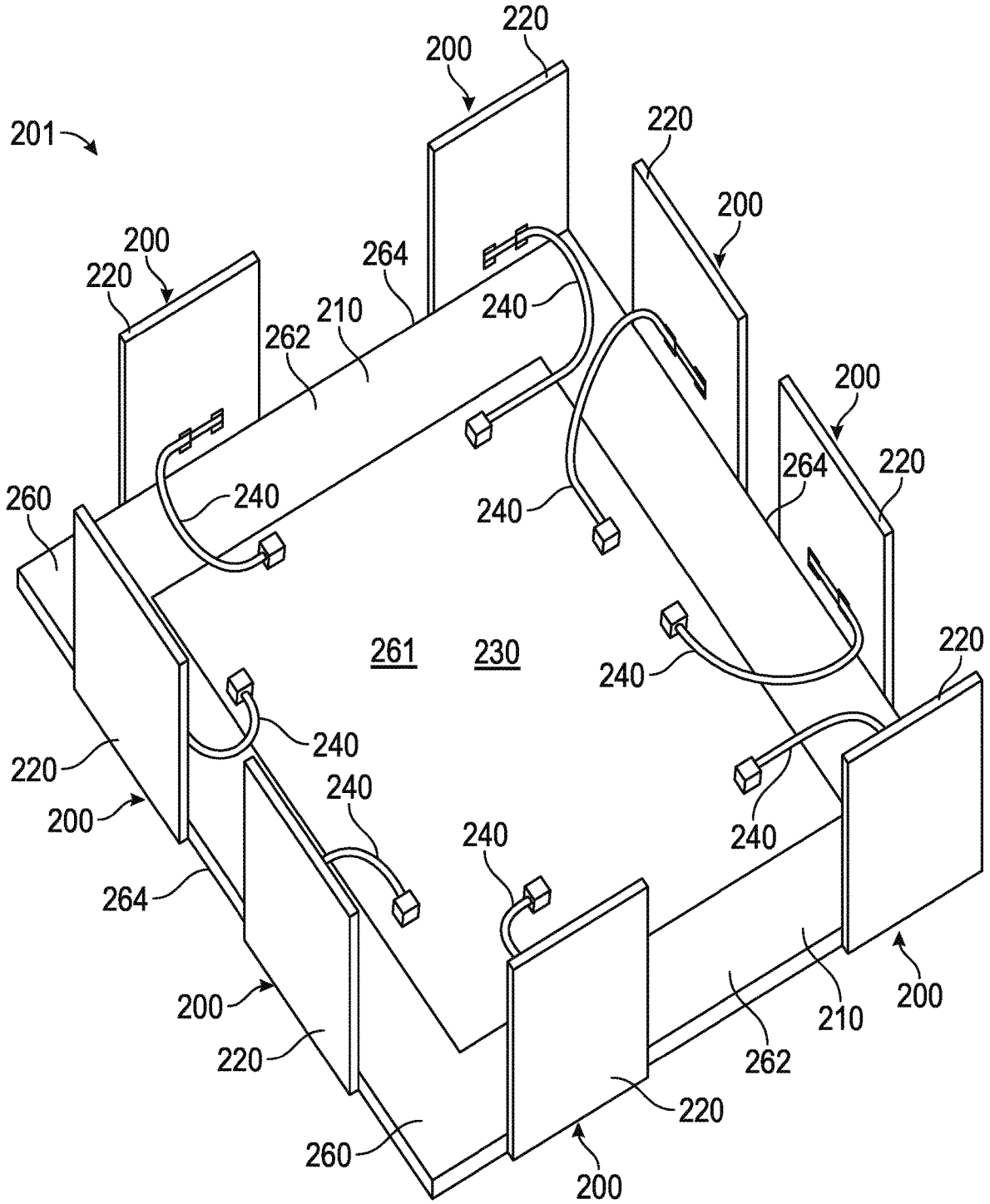
FIG. 6 shows a perspective view of a MIMO system in accordance with a second illustrated embodiment.

FIG. 6 shows a perspective view of a MIMO system (201) in accordance with a second illustrated embodiment. The MIMO system comprises a system substrate (260) having a perimeter (262) and a center portion (261) disposed therebetween. The perimeter comprises a clearance zone (210) and the center portion comprises a ground plane (230). Disposed on a substrate periphery (263) are a plurality of sides (264). As shown, each of the plurality of sides comprises a plurality of antenna systems (200), namely two. Each of the plurality of antenna systems couples to the MIMO system ground plane via a short cable (240) coupled to the ground plane and further coupled to each antenna element (220) of each of the plurality of antenna systems.

Each antenna element (220) is acting as both a resonator and absorber and will impact neighboring antenna elements and could affect performance. By utilizing various combinations of cable length and short cable routing, an extra level of tuning is achieved without altering the antenna element and bandwidth can be widened. Each side comprises two antenna systems (200) having the short cable (240) be in mirror configuration with each other. As shown, the MIMO system comprises a forward C short cable routing and inverted C short cable routing. Other routing configurations be used for each side. For example, on a side with two antenna systems having two short cables, one of the short cable routings can be any of the forward routing configurations (C, L, or S) and the other short routing can be any of the inverted routing configurations (C, L, or S). A short cable routing pair may include a forward C with an inverted C, a forward C with an inverted L, a forward C with an inverted S, a forward S with an inverted C, a forward S with an inverted L, a forward S with inverted S, a forward L with an inverted C, a forward L with an inverted L, or a forward L with an inverted S. Each pair of short cable can be alternated from left to right. For example, a short cable routing pair may comprise from left to right the forward C and the inverted S, or alternatively may comprise form left to right the inverted S and the forward C.

Third Illustrated Embodiment

Figure 7:
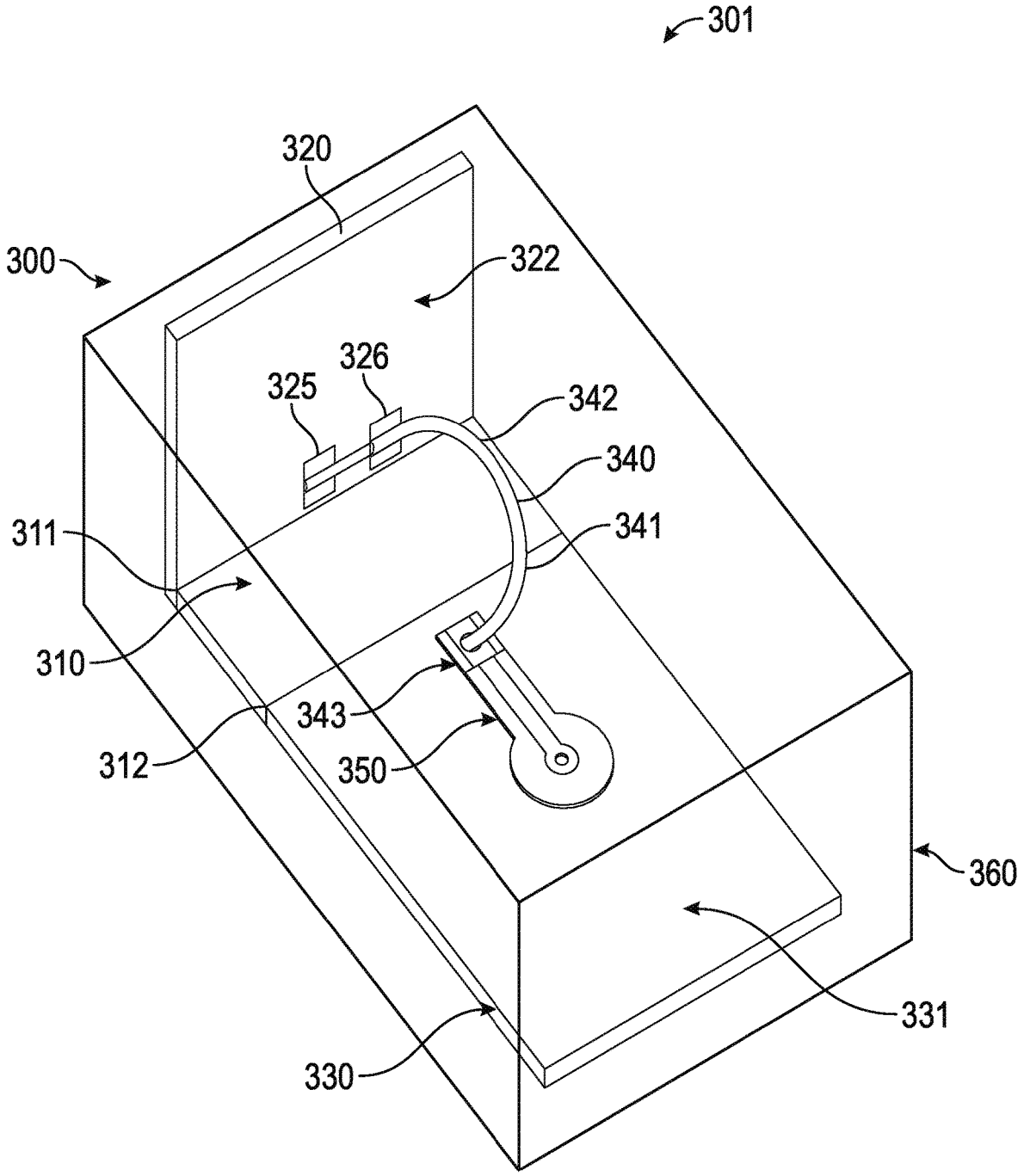
FIG. 7 shows a perspective view of a development kit in accordance with a third illustrated embodiment.

FIG. 7 shows a perspective view of a development kit (301) in accordance with a third illustrated embodiment. The development kit comprises an antenna system (300) encapsulated within a plastic housing (360). The antenna system comprises an antenna element (320) electrically coupled to a ground plane (330) by a short cable (340) wherein the short cable comprises at least one bend (342). Disposed between the antenna element and ground plane and further disposed below the short cable is a nonconductive clearance zone (310). The short cable terminates at the ground plane by a ground terminal (343), the ground terminal being coupled to a transmission line (350) at a first terminal (351) of the transmission line. A second terminal (352) of the transmission line extends away from the clearance zone and the antenna element. The second terminal couples with a connector (353) for connecting to a radio. The connector is disposed on a bottom surface (332) of the ground plane. The plastic housing may comprise 6, 5, 4, 3, or 2 faces of covers.

Figure 8:
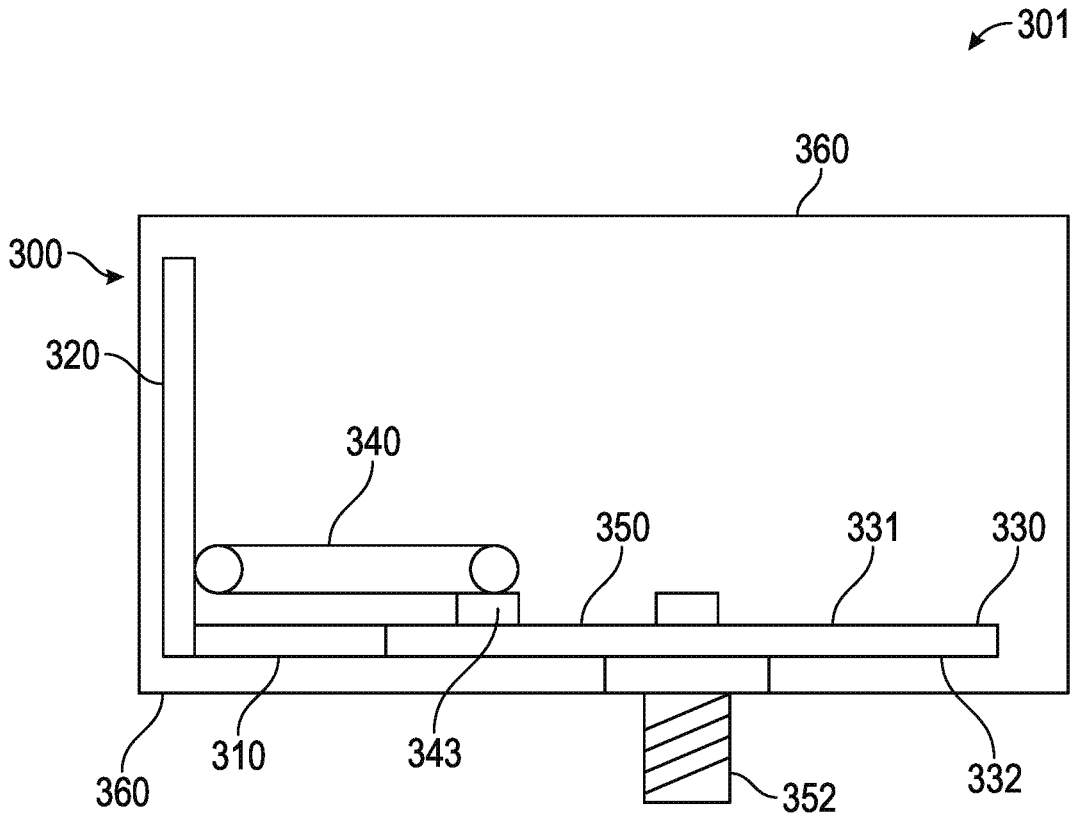
FIG. 8 shows a side view of the development kit according to the third illustrated embodiment.

FIG. 8 shows a side view of the development kit (301) according to the third illustrated embodiment. The development kit comprises a plastic housing (360) surrounding an antenna system (300), the antenna system comprising an antenna element (320) coupled to a clearance zone (310) and the clearance zone coupled to a ground plane (330). A short cable (340) electrically couples the ground plane with the antenna element. The short cable couples to the ground plane via a ground terminal (343), the ground terminal being electrically coupled to a connector (353) via a transmission line (350). As shown, the ground terminal and transmission line are disposed on a top surface (331) of the ground plane. The connector is disposed on a bottom surface (332) of the ground plane wherein the connector is exterior to the plastic housing. In other embodiments, the antenna angle between the antenna element and the clearance zone is les than one-hundred and eight degrees to reduce overall size of the kit.

FEATURE LIST antenna system (100, 200, 300)
clearance zone (110, 210, 310)
first end (111, 311)
second end (112, 312)
antenna element (120, 220, 320)
antenna angle (121, 221, 321)
plurality of elements (122, 222, 322)
collinear element (123)
non-collinear element (124)
positive terminal pad (125; 325)
negative terminal pad (126, 226, 326)
antenna substrate (127)
ground plane (130, 230, 330)
top surface (131, 231, 331)
bottom surface (132, 232, 332)
short cable (140, 240, 340)
short cable routing (141, 341)
bend (142, 342)
ground terminal (143, 343)
forward S short cable routing (144)
forward L short cable routing (145)
forward C short cable routing (146)
inverted S short cable routing (147)
inverted L short cable routing (148)
inverted C short cable routing (149)
transmission line (150, 350)
first terminal (151, 351)
second terminal (152, 352)
connector (153, 353)
MIMO system (201)
system substrate (260)
center portion (261)
perimeter (262)
substrate periphery (263)
plurality of sides (264)
development kit (301)
plastic housing (360)

What is claimed is:

1. An antenna system, comprising:

a clearance zone having a first end and a second end opposite the first end;

an antenna element coupled to the clearance zone at the first end, the antenna element and clearance zone forming an antenna angle;

a ground plane coupled to the clearance zone at the second end, the ground plane having a top surface and a bottom surface opposite the top surface; and a short cable coupled to the top surface at a ground terminal and further coupled the antenna element, the short cable having a short cable routing.

2. The antenna system of claim 1, the antenna element further comprising a plurality of elements, wherein at least one of the plurality of elements comprises a collinear element and at least one of the plurality of elements comprises a non-collinear element.

3. The antenna system of claim 1, the antenna element further comprising a plurality of elements, wherein each of the plurality of elements comprises either a collinear element or a non-collinear element.

4. The antenna system of claim 1, the ground plane further comprising a transmission line disposed on the top surface, the transmission line having a first terminal and a second terminal, wherein the first terminal is electrically coupled to the ground terminal, and the transmission line extends from the first terminal away from the antenna element.

5. The antenna system of claim 4, further comprising a connector electrically coupled to the second terminal.

6. The antenna system of claim 5, wherein the connector is disposed on the bottom surface of the ground plane.

7. The antenna system of claim 1, wherein the short cable routing comprises one of a forward S, a forward L, a forward C, an inverted S, an inverted L, or an inverted C.

8. The antenna system of claim 1, wherein the antenna angle comprises an angle between an inclusive of ninety and two-hundred and seventy degrees.

9. A MIMO system, comprising:

a system substrate comprising a center portion, a perimeter bordering the center portion, and a substrate periphery having a plurality of sides;

a clearance zone disposed on the perimeter;

a ground plane disposed on the center portion; and a plurality of antenna systems disposed on the substrate periphery, each of the plurality of antenna systems comprising:

an antenna element coupled to the clearance zone, the antenna element and clearance zone forming an antenna angle, a short cable coupled to the ground plane at a ground terminal and further coupled the antenna element, the short cable having a short cable routing.

10. The MIMO system of claim 9, each of the antenna elements further comprising a plurality of elements, wherein at least one of the plurality of elements comprises a collinear element and at least one of the plurality of elements comprises a non-collinear element.

11. The MIMO system of claim 9, each of the antenna elements further comprising a plurality of elements, wherein each of the plurality of elements comprises either a collinear element or a non-collinear element.

12. The MIMO system of claim 9, wherein each of the short cable routings comprises one of a forward S, a forward L, a forward C, an inverted S, an inverted L, or an inverted C.

13. The MIMO system of claim of claim 12, wherein each of the plurality of sides comprises two antenna systems, and further wherein the short cable routing of one of the antenna systems comprises the forward S, forward L, or forward C.

14. The MIMO system of claim 13, wherein the short cable routing of one of the antenna systems comprises the inverted S, inverted L, or inverted C.

15. The MIMO system of claim 9, wherein the antenna angle comprises an angle between an inclusive of ninety and one hundred and eighty degrees.

16. A development kit, comprising:

an antenna system having:

a clearance zone having a first end and a second end opposite the first end, an antenna element coupled to the clearance zone at the first end, the antenna element and clearance zone forming an antenna angle, a ground plane coupled to the clearance zone at the second end, the ground plane having a top surface and a bottom surface opposite the top surface, and a short cable coupled to the top surface at a ground terminal and further coupled the antenna element, the short cable having a short cable routing;

a plastic housing encapsulating at least a portion of the antenna system; and a connector electrically coupled to the short cable, the connector extending from the bottom surface of the ground plane.

17. The development kit of claim 16, the antenna element further comprising a plurality of elements, wherein at least one of the plurality of elements comprises a collinear element and at least one of the plurality of elements comprises a non-collinear element.

18. The development kit of claim 16, the ground plane further comprising a transmission line disposed on the top surface, the transmission line having a first terminal and a second terminal, wherein the first terminal is electrically coupled to the ground terminal, and the second terminal is electrically coupled to the connector.

19. The development kit of claim 16, wherein the short cable routing comprises one of a forward S, a forward L, a forward C, an inverted S, an inverted L, or an inverted C.

20. The development kit of claim 16, wherein the antenna angle comprises an angle between an inclusive of ninety and two-hundred and seventy degrees.

* * * * *